US007584572B2

(12) United States Patent
Yokomori et al.

(10) Patent No.: US 7,584,572 B2
(45) Date of Patent: Sep. 8, 2009

(54) DRIVING APPARATUS FOR VEHICLE DOOR

(75) Inventors: Kazuhito Yokomori, Nirasaki (JP); Hiroshi Sato, Yamanashi-ken (JP)

(73) Assignee: Mitsui Mining and Smelting Co., Ltd. (JP)

( * ) Notice: Subject to any disclaimer, the term of this patent is extended or adjusted under 35 U.S.C. 154(b) by 509 days.

(21) Appl. No.: 11/275,064

(22) Filed: Dec. 7, 2005

(65) Prior Publication Data

US 2006/0156630 A1 Jul. 20, 2006

(30) Foreign Application Priority Data

Jan. 17, 2005 (JP) ..... P2005-008487

(51) Int. Cl.
*E05F 11/00* (2006.01)

(52) U.S. Cl. ..... 49/360; 49/348; 49/349; 49/352

(58) Field of Classification Search ..... 49/360, 49/348, 349, 352
See application file for complete search history.

(56) References Cited

U.S. PATENT DOCUMENTS 5,875,588 A * 3/1999 Torii et al. ..... 49/349
5,920,159 A * 7/1999 Miller et al. ..... 318/4
6,125,583 A * 10/2000 Murray et al. ..... 49/291
6,125,586 A * 10/2000 Buscher ..... 49/360
6,179,742 B1 * 1/2001 Haag et al. ..... 475/154
6,460,295 B1 * 10/2002 Johnson et al. ..... 49/360
6,543,581 B1 * 4/2003 Durand et al. ..... 187/316
6,629,905 B1 * 10/2003 Sesselmann et al. ..... 475/149
6,737,823 B2 * 5/2004 Reed et al. ..... 318/466
7,077,773 B2 * 7/2006 Chapman et al. ..... 474/112
7,100,326 B2 * 9/2006 Shimada et al. ..... 49/360
7,287,804 B2 * 10/2007 Yamagishi et al. ..... 296/155
2001/0022049 A1 * 9/2001 Clark et al. ..... 49/360
2001/0054257 A1 * 12/2001 Wygle et al. ..... 49/349
2005/0150167 A1 * 7/2005 Yokomori ..... 49/360
2005/0160674 A1 * 7/2005 Noro et al. ..... 49/360
2006/0150515 A1 * 7/2006 Shiga ..... 49/360
2007/0163179 A1 * 7/2007 Fukumura et al. ..... 49/360

FOREIGN PATENT DOCUMENTS

JP 2000160933 6/2000

* cited by examiner

*Primary Examiner*—Katherine W Mitchell
*Assistant Examiner*—Jeff Tang
(74) *Attorney, Agent, or Firm*—Kilpatrick Stockton LLP

(57) ABSTRACT

A housing, a sun gear rotatably supported in the housing, a ring gear rotatably supported coaxially with the sun gear, a planetary carrier rotatably supported coaxially with the sun gear, a plurality of planetary gears rotatably supported to the planetary carrier and meshing with the sun gear and the ring gear, a motor connected to the ring gear to rotate the ring gear, an electromagnetic brake capable of applying a braking force to rotation of the sun gear, and an actuating member connected to the planetary carrier and linked to a door of a vehicle, and capable of moving the door in opening and closing directions are provided.

2 Claims, 2 Drawing Sheets

DRIVING APPARATUS FOR VEHICLE DOOR

BACKGROUND OF THE INVENTION

1. Field of the Invention

Figure 1:
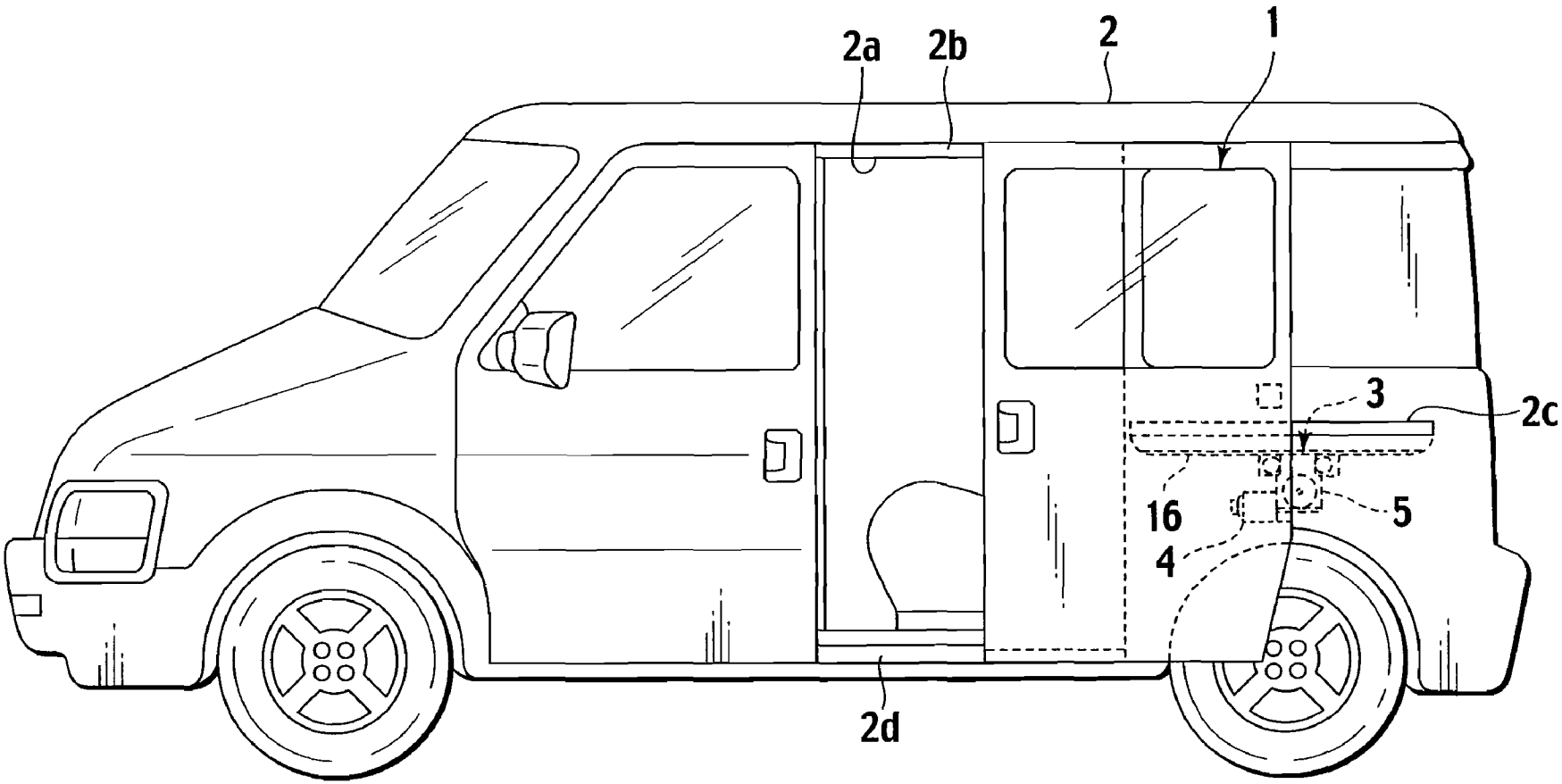

The present invention relates to a driving apparatus for a vehicle door that can drive a door in opening and closing directions.

2. Description of the Related Art

A conventional driving apparatus for a vehicle door includes an electromagnetic clutch that can perform connection and disconnection of an operating force transmission route between an output of a reduction gear mechanism for reducing rotation speed of a motor and an output gear for actuating a cable connected to a slide door. By rotating the motor and putting the operating force transmission route in a connected state using the electromagnetic clutch, the slide door can be moved in opening or closing directions according to motor-driving operation. By disconnecting the operating force transmission route using the electromagnetic clutch, rotation of the output gear according to movement of the slide door is prevented from being transmitted to the reduction gear mechanism and the motor, so that the slide door is put in a manually operable state (for example, see Japanese Patent Application Laid-open No. 2000-160933).

SUMMARY OF THE INVENTION

In the conventional driving apparatus for a vehicle door described above, however, since the electromagnetic clutch is provided in the operating force transmission route between the output of the reduction gear mechanism and the output gear linked to the door, an attracting force of the electromagnetic clutch must be set to withstand an output of the reduction gear mechanism sufficiently. Therefore, as the electromagnetic clutch, a large-sized clutch exerting large attracting force must be used, which results in a problem that the driving apparatus is also large-sized.

The present invention has been achieved in order to solve the above problem, and an object thereof is to provide a reduced-size driving apparatus for a vehicle door.

In order to achieve the above object, according to an aspect of the present invention, there is provided a driving apparatus for a vehicle door that includes a housing; a sun gear supported so as to be able to rotate (termed "rotatably supported" hereinafter) inside of the housing; a ring gear rotatably supported coaxially with the sun gear; a planetary carrier rotatably supported coaxially with the sun gear; a plurality of planetary gears rotatably supported to the planetary carrier and meshing with the sun gear and the ring gear; a motor connected to the ring gear to rotate the ring gear; an electromagnetic brake capable of applying a braking force to rotation of the sun gear; and an actuating member connected to the planetary carrier and linked with a door of a vehicle to be capable of moving the door in opening and closing directions.

According to the aspect of the present invention, by applying a braking force to rotation of the sun gear using the electromagnetic brake, the door can be opened or closed according to motor-driving operation, while the door can be opened or closed lightly according to manual operation by releasing the braking force to allow free rotation of the sun gear. Since a force with a magnitude that only rotation of the sun gear can be blocked will be sufficient at a time of motor-driving operation, the electromagnetic brake can be small-sized so that size reduction of the driving apparatus can be achieved.

By varying a braking force applied to the sun gear according to electric control of the electromagnetic brake, a desired braking force can be applied to movement of the door, so that a speed of the door can be controlled simply and reliably.

The actuating member may be a rotary drum capable of winding a cable connected to the door, and the rotary drum may be rotatably supported coaxially with the planetary carrier.

According to the constitution, the actuating member is the rotary drum capable of winding the cable connected to the door and the rotary drum is rotatably supported coaxially with the planetary carrier, so that rotation of the planetary carrier can be transmitted to the rotary drum reliably.

The ring gear, the sun gear, and the planetary carrier may be rotatably provided on a cylindrical core in the electromagnetic brake.

According to the constitution, since the ring gear, the sun gear and the planetary carrier are rotatably provided on the cylindrical core in the electromagnetic brake, it becomes unnecessary to provide a shaft for rotatably supporting the ring gear, the sun gear, and the planetary carrier in the housing, so that a shape of the housing can be made simple.

An external gear meshing with a worm disposed on the output shaft of the motor may be provided on an outer periphery of the ring gear.

According to the constitution, since the external gear meshing with the worm provided on the output shaft of the motor is provided on the outer periphery of the ring gear, rotation of the motor can be directly transmitted to the ring gear, so that the number of parts can be reduced and simplification of the constitution can be achieved.

BREIF DESCRIPTION OF THE DRAWINGS

Figure 2:
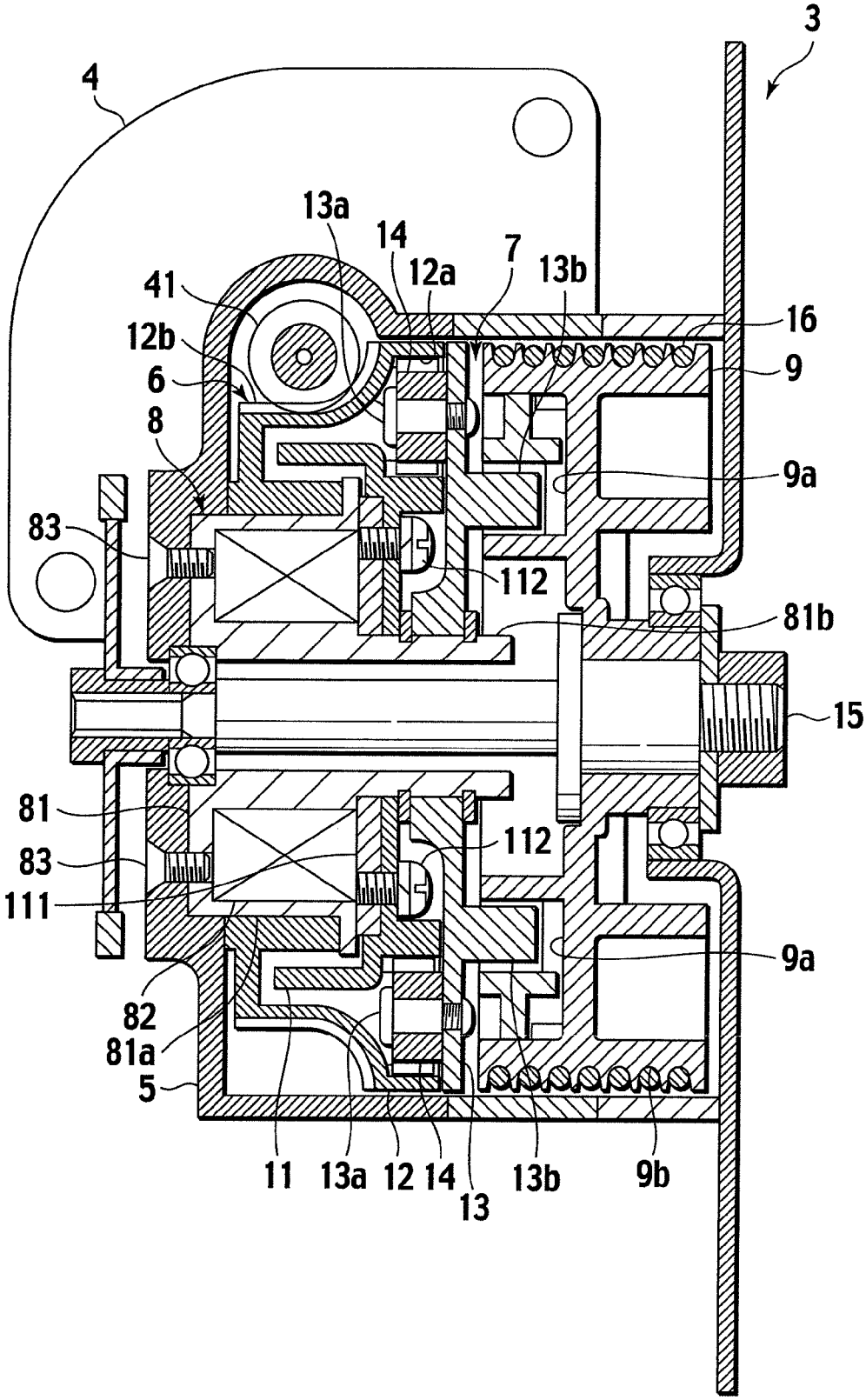

FIG. 1 is a side view of a vehicle to which a driving apparatus for a vehicle door according to an embodiment of the present invention is applied; and FIG. 2 is a vertical sectional enlarged view of relevant parts of a driving apparatus for a vehicle door according to an embodiment of the present invention.

DESCRIPTION OF THE PREFERRED EMBODIMENT

Hereinafter, preferred embodiments of the present invention will be explained with referent to the drawings. In the description of the drawings, like reference numerals refer to like parts. Since respective figures are only illustrative, it should be noted that a relationship between a thickness and a two-dimensional size, a ratio among thickness of respective layers, and the like are different from actual ones.

FIG. 1 is a side view of a vehicle including a slide door 1 to which a driving apparatus for a vehicle door according to an embodiment of the present invention is applied.

A slide door 1 provided in a vehicle is supported movably in a vehicle longitudinal direction by guide rails 2*b*, 2*c*, and 2*d* fixed on a side face of a vehicle body 2 to extend in the vehicle longitudinal direction. The slide door 1 is moved for opening and closing to open and close a door opening 2*a* for getting on and off disposed on a side face of the vehicle body 2 according to manual operation and motor-driving operation based upon driving of a driving apparatus 3 arranged inside a panel of the vehicle body 2. A housing 5 is fixed to the vehicle body 2. A cable 16 is arranged along the guide rail 2*c*. The present invention is also applicable to a door other than the slide door 1, for example, a swing door, a back door, and the like.

FIG. 2 is a vertical sectional enlarged view of relevant parts of the driving apparatus 3. The driving apparatus 3 includes a motor 4 which can be rotated reversibly, the housing 5 fixed to the vehicle body 2, a reduction gear unit 6 for reducing rotation speed of the motor 4, a planetary gear unit 7 housed in the housing 5, an electromagnetic brake 8, and a rotary drum 9 constituting an actuating member.

The planetary gear unit 7 has a sun gear 11, a ring gear 12, a planetary carrier 13, and a plurality of planetary gears 14. The sun gear 11 is rotatably supported in the housing 5. The ring gear 12 and the planetary carrier 13 are rotatably supported coaxially with the sun gear 11. The plurality of planetary gears 14 are rotatably supported to the planetary carrier 13 via shafts 13*a*, respectively, and they are positioned between the sun gear 11 and the ring gear 12 to mesh with them.

The motor 4 and the electromagnetic brake 8 are controlled by a control circuit device (not shown) so as to be driven based upon detection of a detecting sensor for detecting operation of an operation handle disposed on the slide door 1, or an operation of either of operation switch provided inside a car and a wireless remote controller.

When a person pushes the slide door 1 with his/her hand without operating the operation handle to move the same from its half open position in opening or closing directions and it is detected by a speed measuring device (not shown) for detecting a movement of the slide door 1 that a moving speed of the slide door 1 is equal to or faster than a predetermined speed, the slide door 1 can be moved, while moving speed thereof can be reduced to a safe speed, by controlling driving of the electromagnetic brake 8 and the motor 4.

When the vehicle is stopped on a slope area or the like so that the slide door 1 moves from a half open position thereof in opening or closing directions due to its own weight and it is detected by the speed measuring device that the door moving speed is equal to or higher than the predetermined speed, the slide door 1 can be moved, while moving speed thereof can be reduced to a safe speed, by controlling driving of the electromagnetic brake 8 and the motor 4.

The electromagnetic brake 8 has a core 81 made from magnetic substance and fixed in the housing 5 by screws 83, and an annular coil 82 housed in the core 81 and wound cylindrically, and the core 81 is excited by feeding current to the coil 82. A voltage applied to the coil 82 can vary an exciting force generated in the core 81 according to PWM control.

The core 81 is formed in a cylindrical shape with a bottom coaxial with a shaft 15 for rotatably supporting the rotary drum 9 in the housing 5, and it is also formed at a portion thereof near its center with a cylindrical shaft portion 81*b* coaxial with the shaft 15 and inserted with the shaft 15.

The sun gear 11 is rotatably provided on a cylindrical shaft 81 formed on the core 81 to be rotatably supported in the housing 5 so as to be opposed to the coil 82, and it has an annular friction plate 111 formed from magnetic substance and fixed on its left side face opposed to the coil 82 using screws 112. The friction plate 111 is slightly spaced from the core 81 during a non-excitation of the core 81, while the friction plate 111 is attracted to the core 81 at an excited time thereof.

The electromagnetic brake 8 allows free rotation of the sun gear 11 during the non-excitation time, while it blocks rotation of the sun gear 11 completely at the excited time by attracting the friction plate 111 to the core 81 to apply a braking force to rotation of the sun gear 11. A half braking state, namely, a state in which the friction plate 111 can slide on the core 81 to rotate against an attracting force by controlling a voltage applied to the coil 82 may be adopted.

The ring gear 12 is rotatably provided on an outer peripheral portion 81*a* of the core 81 in the electromagnetic brake 8, and it has an internal gear 12*a* meshing with the planetary gears 14 on its inner periphery. The ring gear 12 has an external gear 12*b* meshing with a worm 41 attached to an output shaft 4*a* of the motor 4 non-reversibly, and it rotates in a predetermined direction based upon rotation of the motor 4 in a reduction manner. The reduction gear unit 6 in the embodiment includes a worm gear mechanism having the worm 41 and an external gear 12*b* meshing with the worm 41 non-reversibly. By providing the external gear 12*b* meshing with the worm 41 provided on the output shaft 4*a* of the motor 4 on the outer periphery of the ring gear 12, rotation of the motor 4 can be directly transmitted to the ring gear 12, so that the constitution of the reduction gear unit 6 can be simplified.

The planetary carrier 13 is rotatably provided on the cylindrical shaft 81*b* of the core 81 so that it is rotatably supported in the housing 5 so as to be opposed to a right side face of the sun gear 11. The planetary carrier 13 is connected so as to be rotatable integrally with the rotary drum 9 by causing a projection 13*b* provided on a right side face opposed to a side face of the rotary drum 9 to engage a recess 9*a* of the rotary drum 9.

The rotary drum 9 is rotatably supported within the housing 5 coaxially with the planetary carrier 13, namely, by the shaft 15, and a cable 16 is wound on a spiral groove 9*b* formed on an outer periphery of the rotary drum 9 so as to be reeled and wound off. By rotatably supporting the rotary drum 9 coaxially with the planetary carrier 13 in this manner, rotation of the planetary carrier 13 can be transmitted to the rotary drum 9 reliably.

In the embodiment, though the actuating member is constituted as the rotary drum 9 capable of winding the cable 16, instead of this constitution, the actuating member can also be constituted as an arm member whose one end is linked to the door 1 and whose other end is coupled to the planetary carrier 13 so that it is made rotatable together with the planetary carrier 13 and the door is moved in opening and closing directions according to rotation of the arm member. In that case, the arm member may be rotatably supported at either of positions concentric and eccentric to the planetary carrier 13.

The cable 16 is arranged along the guide rail 2*c* and is connected to a rear end of the slide door 1. The cable 16 is wound in the spiral groove 9*b* according to rotation of the rotary drum 9 depending on rotation of the planetary carrier 13, so that the slide door 1 can be moved in opening and closing directions.

The rotary drum 9 is rotated in synchronization with movement of the slide door 1 and a rotary sensor (not shown) which generates a pulse signal corresponding to a rotational angle and a rotational direction of the rotary drum 9 is disposed on the shaft 15 rotated integrally with the rotary drum 9. The speed measuring device measures a moving speed and a moving direction of the slide door 1 based upon a pulse signal from the rotary sensor.

As described above, by rotating the motor 4 in a state that rotation of the sun gear 11 has been completely blocked by excitation of the electromagnetic brake 8, the ring gear 12 is rotated with a reduced speed via the reduction gear unit 6. The planetary gears 14 rotate on their axes according to rotation of the ring gear 12, while rotate around the sun gear 11. Thereby, the planetary carrier 13 rotates around the cylindrical shaft 81*b* to rotate the rotary drum 9. The rotary drum 9 rotates according to rotation of the planetary carrier 13 to wind off or wind the cable 16, thereby moving the slide door 1 in opening or closing directions.

Since the sun gear 11 is freely rotatable at a non-excitation time of the electromagnetic brake 8, even if the external gear 12*b* of the ring gear 12 meshes with the worm 41 non-reversibly so that rotation of the ring gear 12 is in a blocked state, the planetary carrier 13 can rotate freely around the cylindrical shaft 81*b*, while rotating the sun gear 11 meshing with the planetary gear 14. Accordingly, the rotary drum 9 and the planetary carrier 13 can be rotated at a time of manual operation of the slide door 1 without load necessary to reverse the motor 4, so that the slide door 1 can be moved lightly in opening and closing directions.

When the speed measuring device detects a speed equal to or faster than the predetermined speed, rotation of the sun gear 11 is blocked by driving of the electromagnetic brake 8, and a braking force is applied to rotation of the planetary carrier 13 to an input from the rotary drum 9. At that time, when rotation of the sun gear 11 is blocked and an urgent braking force is applied to the planetary carrier 13, not only the speed of the slide door 1 cannot be reduced smoothly, but also excessive load may be imparted to each connection portion, which results in damage of the connection portion. In such a case, by varying the voltage applied to the coil 82 of the electromagnetic brake 8 according to the PMW control corresponding to the speed of the slide door 1, the electromagnetic brake 8 is put in a half braking state until the speed of the slide door 1 is reduced to the predetermined speed. When the speed of the slide door 1 has been reduced to the predetermined speed, the motor 4 is rotated and rotation of the sun gear 11 is completely blocked by the electromagnetic brake 8 so that the slide door 1 can be moved at a safe speed while its speed is being reduced smoothly.

As described above, in the embodiment, by applying a braking force on rotation of the sun gear 11 using the electromagnetic brake 8, the slide door 1 can be opened or closed according to motor-driving operation, while the door slide 1 can be opened or closed lightly according to manual operation by releasing the braking force to allow free rotation of the sun gear 11. Since a force with a magnitude that only rotation of the sun gear 11 can be blocked will be sufficient at a time of motor-during operation, the electromagnetic brake 8 can be small-sized so that size reduction of the driving apparatus 3 can be achieved. Further, by PMW-controlling a voltage applied to the coil 82 of the electromagnetic brake 8 to vary a braking force applied to the sun gear 11, a desired braking force can be applied to movement of the slide door 1, so that the speed of the slide door 1 can be controlled easily and reliably.

Since the sun gear 11, the ring gear 12, and the planetary carrier 13 are rotatably provided on the cylindrical core 81 in the electromagnetic brake 8, it is unnecessary to provide a shaft for rotatably supporting the sun gear 11, the ring gear 12, and the planetary carrier 13 in the housing 5 separately, so that the shape of the housing 5 can be simplified.

While the present invention has been described with respect to the preferred embodiments thereof, it should be understood that the invention is not limited thereto, and the constitutions of respective parts of the preferred embodiments can be replaced by other constitutions which have equivalent functions.

What is claimed is:

1. A driving apparatus for a vehicle door, comprising:

a housing;

a sun gear rotatably supported in the housing;

a ring gear rotatably supported coaxially with the sun gear;

a planetary carrier rotatably supported coaxially with the sun gear;

a plurality of planetary gears rotatably supported to the planetary carrier and meshing with the sun gear and the ring gear;

a motor connected to the ring gear to rotate the ring gear;

an electromagnetic brake capable of applying a braking force to rotation of the sun gear; and an actuating member connected to the planetary carrier and linked to a door of a vehicle, and capable of moving the door in opening and closing directions, wherein the actuating member is a rotary drum capable of winding a cable connected to the door, the rotary drum is rotatably supported coaxially with the planetary carrier, the electromagnetic brake includes a cylindrical core, and the ring gear, the sun gear, and the planetary carrier are rotatably provided on the cylindrical core of the electromagnetic brake, the rotary drum has a drum shaft, and the cylindrical core is formed in a cylindrical shape with a bottom coaxial with the drum shaft rotatably supporting the rotary drum in the housing and is formed at a portion of the cylindrical core near a center of the cylindrical core with a cylindrical shaft portion coaxial with the drum shaft and inserted with the drum shaft, the planetary carrier and the sun gear are rotatably provided on the cylindrical shaft portion, and the planetary carrier is opposed to a side face of the sun gear and is connected so as to be rotatable integrally with the rotary drum by engagement of a projection provided on the other side face of the planetary carrier opposed to a side face of the rotary drum and a recess provided on the side face of the rotary drum.

2. The driving apparatus for a vehicle door according to claim 1, wherein an external gear meshing with a worm provided on an output shaft of the motor are provided on an outer periphery of the ring gear.

* * * * *